US009338540B2

(12) United States Patent
Nicholson

(10) Patent No.: US 9,338,540 B2
(45) Date of Patent: May 10, 2016

(54) DEVICE CONTROL BASED ON WORN HEADPHONE DETECTION

(71) Applicant: Lenovo (Singapore) Pte. Ltd., Singapore (SG)

(72) Inventor: John Weldon Nicholson, Cary, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 195 days.

(21) Appl. No.: 14/030,781

(22) Filed: Sep. 18, 2013

(65) Prior Publication Data

US 2015/0078573 A1 Mar. 19, 2015

(51) Int. Cl.
*H04R 1/10* (2006.01)

(52) U.S. Cl.
CPC ..... *H04R 1/1041* (2013.01); *H04R 1/10* (2013.01)

(58) Field of Classification Search
CPC . H04M 1/23; H04M 1/7255; H04M 3/42204; H04M 3/4936; H04M 11/10; H04M 1/10
USPC ..... 379/67.1, 201.1, 88.01; 455/41.1–41.3; 370/352
See application file for complete search history.

(56) References Cited

U.S. PATENT DOCUMENTS

| | | | | |
|---|---|---|---|---|
| 5,978,460 | A * | 11/1999 | Butts | H04M 17/023 379/145 |
| 2012/0045990 | A1* | 2/2012 | Sandell | H04M 1/6066 455/41.2 |
| 2013/0208717 | A1* | 8/2013 | Kannappan | 370/352 |

* cited by examiner

*Primary Examiner* — Md S Elahee
(74) *Attorney, Agent, or Firm* — Schwegman, Lundberg & Woessner, P.A.

(57) ABSTRACT

A system and method include receiving a headphone worn signal at a system representative of a detection of headphones being worn and controlling selection of a playback device via the system for audible sounds as a function of the headphone worn signal.

13 Claims, 3 Drawing Sheets

DEVICE CONTROL BASED ON WORN HEADPHONE DETECTION

BACKGROUND

In an open office space, it is often necessary to wear headphones when listening to a length audio content, such as training material or product demonstrations. Many times a computer system will detect when the headphones are plugged into the system, and automatically direct sound to the headphones. Users may also manually select a playback device.

SUMMARY

A method includes receiving a headphone worn signal at a system representative of a detection of headphones being worn, and controlling selection of a playback device via the system for audible sounds as a function of the headphone worn signal.

An information handling system readable storage device has instructions for causing the information handling system to perform a method. The method includes receiving a headphone worn signal at a system representative of a detection of headphones being worn and controlling selection of a playback device via the system for audible sounds as a function of the headphone worn signal.

A system includes a processor, a storage device coupled to the processor, an audio controller to select a playback device, a speaker playback device selectable by the audio controller, and a headphone playback device connector selectable by the audio controller, the connector configured to receive a headphone signal indicative of whether a headphone is being worn, wherein the audio controller selects the playback device as a function of the received headphone signal.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

The functions or algorithms described herein may be implemented in hardware, software or a combination of hardware, software and human implemented procedures in one embodiment. The software may consist of computer executable instructions stored on computer readable media such as memory or other type of storage devices. Further, such functions correspond to modules, which are software, hardware, firmware or any combination thereof. Multiple functions may be performed in one or more modules as desired, and the embodiments described are merely examples. The software may be executed on a digital signal processor, ASIC, microprocessor, or other type of processor operating on a computer system, such as a personal computer, tablet, smart phone, server or other computer system.

Figure 1:
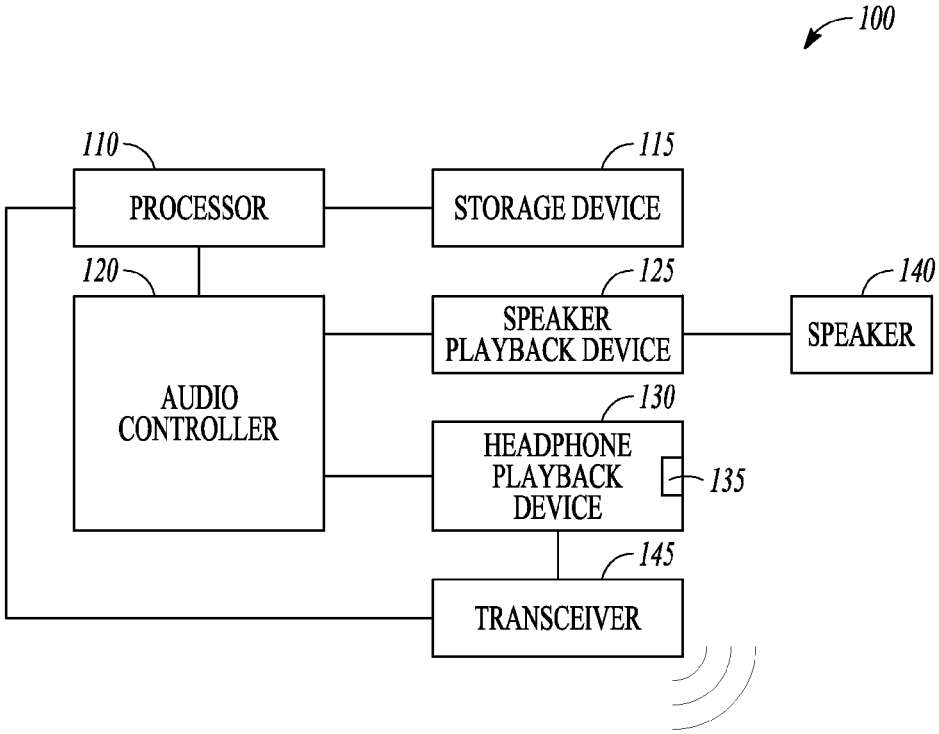
FIG. 1 is a block diagram of an information handing system that directs audio signals depending on whether a headphone is being worn according to an example embodiment.

FIG. 1 is a block diagram of an information handling system 100 that directs audio signals to one of at least two playback devices depending on whether one of the playback devices is being worn by a user. System 100 includes a processor 110 coupled to execute code stored on a storage device 115. Processor 110 is also coupled to an audio controller 120 to select one of multiple playback devices. A speaker playback device 125 is one of the playback devices selectable by the audio controller 120. A headphone playback device 130 has a connector selectable by the audio controller 120 in one embodiment. The connector 135 may be an audio speaker jack, such as a standard audio speaker jack having connections for left, right, and ground in one embodiment. The connector 135 may be configured to receive a headphone signal indicative of whether a headphone is being worn. The audio controller 120 receives the headphone signals and selects the playback device as a function of the received headphone signal.

In one embodiment, the if the headphone signal is indicative of the headphone not being worn by a user, the audio controller 120 selects the speaker playback device as the default playback device, and sound, such as alerts or other content, including voice, music, etc., are played through a speaker 140. If the headphone signal is indicative of the headphone being worn by a user, the audio controller 120 selects the headphone playback device 130, causing audio signals to be transmitted via connector 135, or wirelessly via a transceiver 145, such as a Bluetooth, or other wireless protocol.

In one embodiment, audio controller 120 may be implemented as a processor or microcontroller executing code stored in a memory. For example, audio controller 120 may be implemented by a main system processor, such as processor 110, executing code stored in a main memory, which main memory may be storage device 115.

Figure 2:
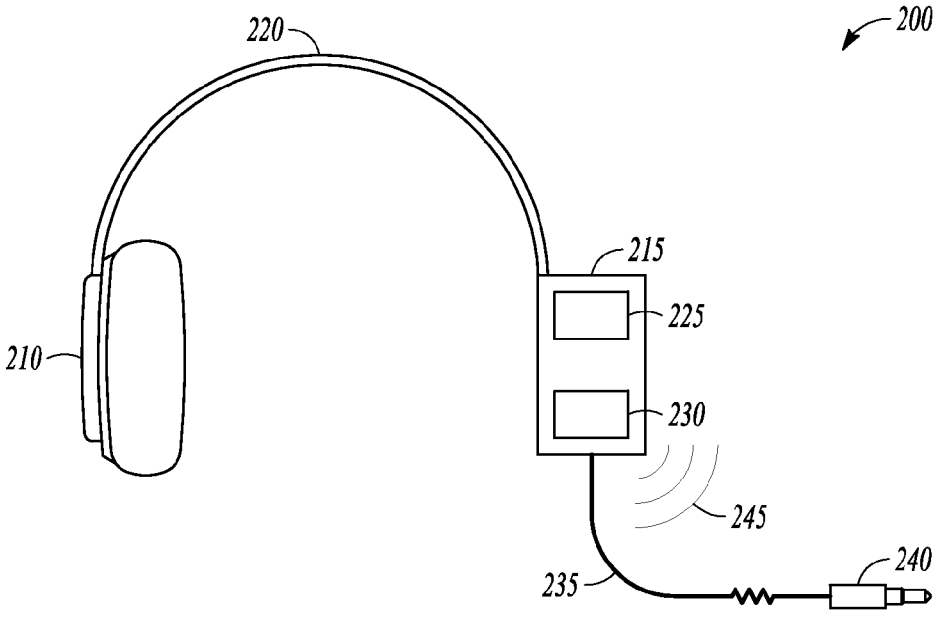
FIG. 2 is a block diagram representation of a headphone that detects whether the headphone is being worn according to an example embodiment.

A block diagram representation of a headphone 200 is illustrated in FIG. 2. The headphone 200 in one embodiment may include many different types of headsets, from single ear Bluetooth headsets to a pair of headphone speakers 210, 215 supported by a band 220 to fit over or on both ears of a wearer. In one embodiment, a sensor 225 is coupled to one of the headphone speakers 210, positioned to detect whether or not the headset is being worn. The sensor 225 may be a proximity sensor, a capacitive based sensor, a pulse detector, or any other type of sensor from which signals may be generated indicative of whether or not the headset is being worn by a user.

The sensor 225 in one embodiment is coupled to circuitry 230 to receive the sensor signals and to generate the headphone signal responsive to the sensor signals indicative of whether or not the headphone 200 is being worn. The signal in one embodiment utilizes a ground conductor of an electrical cord 235 coupled to the circuitry 230, and terminated in a male audio connector 240 capable of coupling to the connector 135 and carrying left, right and ground signals. The headphone signal may be communicated via the ground connector or pin in one embodiment, or may be carried by simply shorting one or more conductors to the ground conductor, which may be detected by the headphone playback device 130. In further embodiments, the circuitry 230 includes a transceiver already utilized for providing audio signals to the headset for playback. The transceiver may be used to provide wireless signals, such as Bluetooth signals, corresponding to whether the headset 200 is being worn or not.

Figure 3:
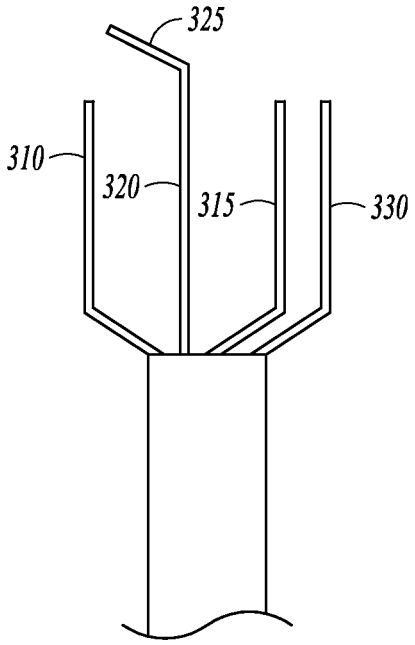
FIG. 3 is a block schematic diagram of a three conductor cable for headphones according to an example embodiment.

FIG. 3 is a block schematic diagram of a four conductor cable 300 according to an example embodiment. Cable 300 in one embodiment is a TRRS (tip, ring, ring, sleeve) four contact connector with integrated microphone that plugs into a compatible connector, such as a jack on the system. The conductors include microphone conductor 310, a ground conductor 320, and left and right conductors 315 and 330. A switch 325 in one embodiment is used to couple one of the conductors to ground to indicate that the headphones are not being worn. In one embodiment, the switch 325 connects the microphone conductor to ground. The switch essentially shorts to conductors together or float conductors to simulate conditions of the jack that exist when the connector is not plugged into the system. Other methods of communicating that the headphones are not being worn may also be employed, including simulating impedances seen by the system when the connector is not plugged into the jack. This may be used where the headphone does not have a microphone and employs a TRS connector.

Figure 4:
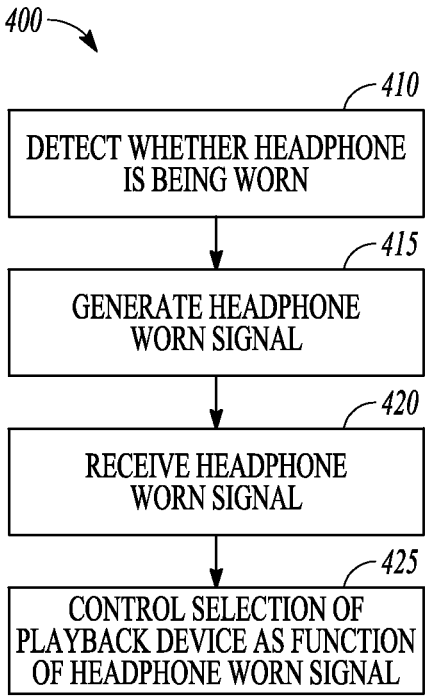
FIG. 4 is a flowchart diagram illustrating a method of controlling a playback device as a function of whether or not headphones are being worn according to an example embodiment.

FIG. 4 is a flowchart representation of a method 400 to control which of multiple playback devices are to be used for playback of sound according to an example embodiment. At 410, a headphone 200 detects whether or not the headphone is being worn. As mentioned above, many different types of sensors may be used to facilitate such detection. In various embodiments, a proximity sensor, capacitive sensor, pulse detector, or other sensor may be used. The headphone then generates a signal at 415 responsive to detecting whether or not the headphone is being worn.

At 420, the system 100 receives a headphone worn signal at a system representative of a detection of headphones being worn. The signal may be received via a speaker jack type connection or wirelessly via a Bluetooth or other wireless protocol. At 425, the system controls selection of a playback device for audible sounds as a function of the headphone worn signal. The audible sounds may include alerts, alarms, voice, music, or other audible sounds in further embodiments. Use of the headphone worn signal relieves a user of having to unplug a cable, or otherwise modify a choice of playback device whenever the headphones are put on or taken off.

In one embodiment, the headphone worn signal is in a first state when the headphone is detected as being worn and in a second state when the headphone is detected as not being worn. The headphone worn signal may be received via the speaker jack to which the headphone is connected, and may include either a signal on a ground line, or a short between a ground pin and a channel of an audio connector plugged into the speaker jack. In a further embodiment, the headphone worn signal is received via a wireless connection between the headphone and the system. The playback device may be selected from the group consisting of the headphones and a system speaker, wherein the system speaker is selected when the headphone worn signal indicates that the headphone is not being worn.

Figure 5:
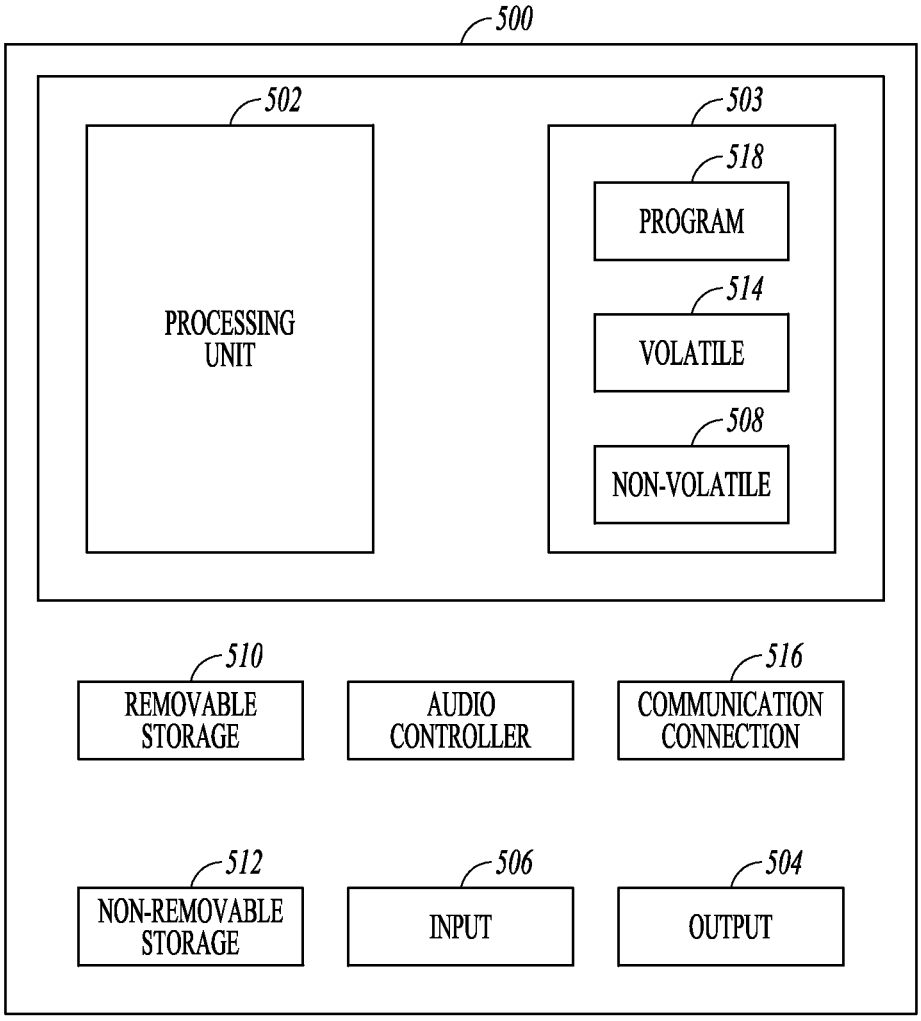
FIG. 5 is a block diagram of an information handling system according to an example embodiment.

FIG. 5 is a block schematic diagram of an information handling system such as a computer system 500 to implement one or more embodiments. An object-oriented, service-oriented, or other architecture may be used to implement such functions and communicate between the multiple systems and components. One example computing device in the form of a computer 500 may include a processing unit 502, memory 503, removable storage 510, and non-removable storage 512. Memory 503 may include volatile memory 514 and non-volatile memory 508. Computer 500 may include—or have access to a computing environment that includes—a variety of computer-readable media, such as volatile memory 514 and non-volatile memory 508, removable storage 510 and non-removable storage 512. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices, or any other medium capable of storing computer-readable instructions. Computer storage and computer-readable media exclude carrier waves travelling through space, sometimes referred to as "signals." Computer 500 may include or have access to a computing environment that includes input 506, output 504, and a communication connection 516. The computer may operate in a networked environment using a communication connection to connect to one or more remote computers, such as database servers. The remote computer may include a personal computer (PC), server, router, network PC, a peer device or other common network node, or the like. The communication connection may include a Local Area Network (LAN), a Wide Area Network (WAN) or other networks.

Computer-readable instructions stored on a computer-readable medium are executable by the processing unit 502 of the computer 500. A hard drive, CD-ROM, and RAM are some examples of articles including a non-transitory computer-readable medium. For example, a computer program 518 capable of providing generic techniques to perform functions described herein may be included on a CD-ROM and loaded from the CD-ROM to a hard drive. The computer-readable instructions allow computer 500 to perform the herein described functions.

Computer 500 may include smart phones, tablets, or other portable information handling systems in further embodiments, and may also include a touchscreen interface.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A method comprising:

receiving a headphone worn signal to simulate conditions of a connector jack by shorting conductors together at a system representative of the headphones not being plugged in to the connector jack when the headphones are not worn and a detection of headphones being worn; and controlling selection of a playback device via the system for audible sounds as a function of the headphone worn signal, wherein the playback device is selected from the group consisting of the headphones and a system speaker, wherein the system speaker is selected as a default playback device for all sounds when the headphone worn signal indicates that the headphone is not being worn.

2. The method of claim 1 wherein the headphone worn signal is in a first state when the headphone is detected as being worn and in a second state when the headphone is detected as not being worn.

3. The method of claim 1 wherein the playback device is selected from the group consisting of the headphones and a system speaker, wherein the system speaker is selected when the headphone worn signal indicates that the headphone is not being worn.

4. The method of claim 1 and further comprising:

the headphone detecting whether or not the headphone is being worn; and the headphone generating a signal responsive to detecting whether or not the headphone is being worn.

5. The method of claim 4 wherein the headphone uses a proximity sensor to detect whether or not the headphone is being worn.

6. The method of claim 4 wherein the headphone uses a pulse detector to determine whether or not the headphone is being worn.

7. A system comprising:

a processor;

a storage device operatively coupled to the processor;

an audio controller operatively coupled to the storage device to select a playback device;

a system speaker playback device selectable by the audio controller; and a headphone playback device connector jack selectable by the audio controller, the connector jack configured to receive a headphone signal indicative of whether a headphone is being worn to simulate conditions of a connector jack not having a headphone connected by shorting conductors together, wherein the audio controller selects the playback device as a function of the received headphone signal, wherein the playback device is selected from the group consisting of the headphone playback device and the system speaker, wherein the system speaker is selected as a default playback device for all sounds when the headphone worn signal indicates that the headphone is not being worn.

8. The system of claim 7 wherein the headphone playback device connector comprises a speaker jack to which the headphone is connected and wherein the audio controller automatically directs all sound to the headphone responsive to the headphone being connected to the speaker jack provided the headphone is being worn.

9. The system of claim 7 wherein the speaker playback device comprises a speaker.

10. The system of claim 7 and further comprising:

a headphone coupled to the headphone playback device connector, the headphone comprising:

a sensor coupled to detect whether or not the headphone is being worn; and a signal generator to generate a signal responsive to the sensor detecting whether or not the headphone is being worn.

11. An information handling system readable storage device having instructions for execution by a processor of the information handling system to perform:

receiving a headphone worn signal to simulate conditions of a connector jack by shorting conductors together at a system representative of the headphones not being plugged in to the connector jack when the headphones are not worn and a detection of headphones being worn; and controlling selection of a playback device via the system for audible sounds as a function of the headphone worn signal, wherein the playback device is selected from the group consisting of the headphones and a system speaker, wherein the system speaker is selected as a default playback device for all sounds when the headphone worn signal indicates that the headphone is not being worn.

12. The information handling system readable storage device of claim 11 wherein the headphone worn signal is in a first state when the headphone is detected as being worn and in a second state when the headphone is detected as not being worn.

13. The information handling system readable storage device of claim 11 wherein the connector jack comprises a speaker jack to which the headphone is connected.

* * * * *